United States Patent [19]

Saunders et al.

[11] Patent Number: 4,522,095

[45] Date of Patent: Jun. 11, 1985

[54] HOLE PUNCH FOR A CUTTING DIE

[75] Inventors: Philip G. Saunders; Jack R. Simpson, both of Toledo, Ohio

[73] Assignee: Container Graphics Corporation, Toledo, Ohio

[21] Appl. No.: 420,729

[22] Filed: Sep. 21, 1982

[51] Int. Cl.[3] ..... B26D 7/06

[52] U.S. Cl. ..... 83/116; 83/117; 83/123; 83/128

[58] Field of Search ..... 83/123, 128, 116, 117, 83/138, 139, 653, 686, 690; 76/107 C; 493/82, 83, 342, 373, 472; 16/2, 108, 109; 403/221, 225, 228; 24/241 R, 241 S

[56] References Cited

U.S. PATENT DOCUMENTS

| | | | |
|---|---|---|---|
| 2,642,240 | 6/1953 | Peirce | 403/225 X |
| 3,827,322 | 8/1974 | Saunders et al. | 83/128 |
| 3,844,532 | 10/1974 | Buck | 16/2 X |
| 3,850,064 | 11/1974 | Dwyer | 83/128 X |
| 4,295,691 | 10/1981 | Rubenthaler | 16/2 X |
| 4,306,476 | 12/1981 | Saunders et al. | 83/128 X |

*Primary Examiner*—Paul A. Bell
*Assistant Examiner*—Taylor J. Ross
*Attorney, Agent, or Firm*—Allen D. Gutchess, Jr.

[57] ABSTRACT

A punch for a cutting die is provided for forming holes in corrugated board or the like. The hole punch includes a tubular metal member of circular transverse cross section having one end substantially flush with the back surface of a die plate in which it is mounted and the other end extending beyond the front surface of the die plate and terminating in a circular cutting edge. A body of resilient material, preferably molded rubber, is located within the cylindrical member and has one end terminating near the back end of the tubular member and another end terminating near the cutting edge of the tubular member. The purpose of the body is to eject and strip the scrap of corrugated board from the punch and from the rest of the blank being formed by the cutting die. The resilient body has a central, cylindrical recess at one end which enables the resilient material to be deformed inwardly when engaging a corrugated board being cut by the circular cutting edge. The other end of the resilient body is closed off which enables the body to be more easily inserted in the tubular metal member. This end is also chamfered which increases the life of the resilient body.

1 Claim, 5 Drawing Figures

HOLE PUNCH FOR A CUTTING DIE

This invention relates to a hole punch for a cutting die for producing holes in corrugated board or the like.

Cutting dies for shaping and forming sheet material, usually corrugated board, can be either flat or rotary. However, rotary dies are being increasingly used because of the higher production rates possible therewith. With the rotary cutting die equipment, a pair of cylinders are mounted in a frame with a gap of predetermined thickness therebetween. One of the cylinders carries a die plate mounted thereon with the appropriate cutting rules and punches. The other cylinder has a yieldable surface, usually a layer of plastic material, which supports the corrugated board when fed between the cylinders as they are rotated in opposite directions.

A cutting die for this operation includes a die plate on which is laid out the appropriate shape of the carton blank or the like to be produced. Saw cuts and holes are then made in the die plate, which is usually of plywood, to provide proper slots and openings for the cutting rules and hole punches.

The hole punch according to the invention includes a tubular member of circular transverse cross section usually held by a friction fit in a hole extending through the die plate. The back end of the tubular member preferably terminates at the back surface of the die plate so that it may be backed up by a die cylinder on which the die plate is mounted. The front end of the tubular member extends beyond the front surface of the die plate and terminates in a circular cutting edge. The cutting edge is spaced from the front surface of the die plate by more than the thickness of the corrugated board in which the hole is to be formed.

A resilient ejection body, preferably of molded gum rubber, is located in the tubular member and has a back end terminating near the back end of the tubular member and a front end terminating near the cutting edge of the tubular member. As the hole is being formed in the corrugated board, the resilient body is deformed, and after the hole is formed, the resilient body returns to its original shape and strips and ejects the scrap of the corrugated board where the hole now exists. The front end of the resilient body can extend slightly beyond or slightly short of the plane of the cutting edge. Particularly with smaller punches, the resilient body preferably extends beyond the cutting edge to provide a more effective stripping and ejecting operation for the scrap.

The resilient body has a central void or recess at the front end adjacent the cutting edge and stopping short of the back end. The recess provides a space into which the end portion of the resilient body adjacent the cutting edge can yield and deform as the hole is being formed in the corrugated board and the resilient body is being forced inwardly. It has been found that the void in the resilient body enables the body to have a substantially longer life than if a solid resilient body were used in the tubular member.

The resilient body is mounted in the tubular member with a friction fit and it has been difficult to assembly the resilient bodies in the members. However, with the resilient body in accordance with the invention, an elongate insertion member can be inserted in the closed-end recess and used to push the resilient body into the tubular member. The resilient body has a diameter slightly exceeding that of the tubular member with the result that the resilient body tends to be elongated and diminishes in diameter as the elongate member is pushed against the closed end of the resilient body and the sides of the body drag on the inner surface of the tubular member. With this arrangement, the resilient body can be inserted into the tubular member in minimum time and yet the body stays securely in place during the operation of the cutting die.

The otherwise circular corner at the closed end of the resilient body is chamfered to produce an annular void between the body and the junction of the tubular member and the die cylinder. It has been found that this chamfer at the closed end of the resilient body increases the life thereof. Apparently this occurs because the annular void enables the resilient body to yield more than otherwise to prevent undue compression, possible build up of heat, and a resulting shortened effective life.

It is, therefore, a principal object of the invention to provide a hole punch for a cutting die having the features and advantages discussed above.

Many other objects and advantages of the invention will be apparent from the following detailed description of a preferred embodiment thereof, reference being made to the accompanying drawings, in which.

Figure 1:
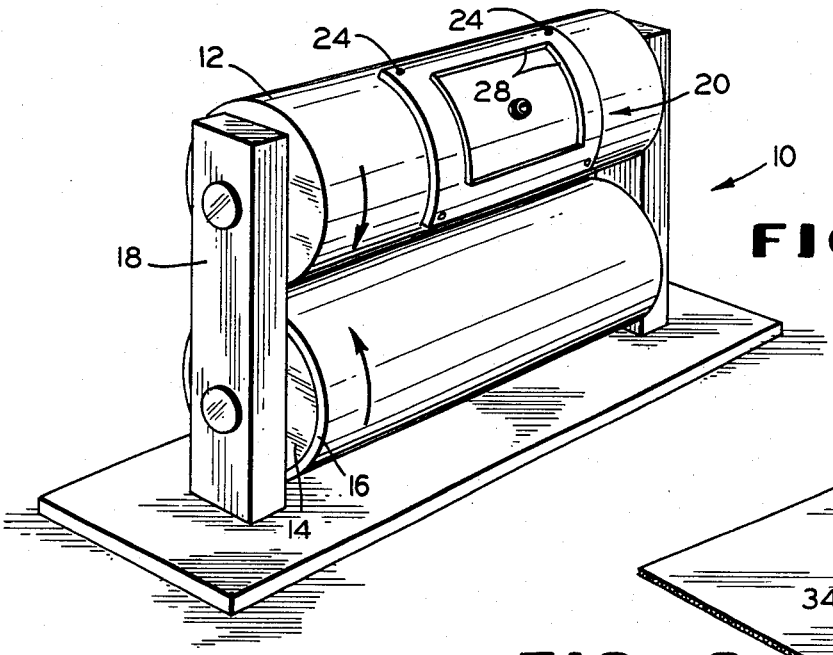
FIG. 1 is a somewhat schematic view in perspective of rotary cutting die equipment embodying the invention.
Figure 2:
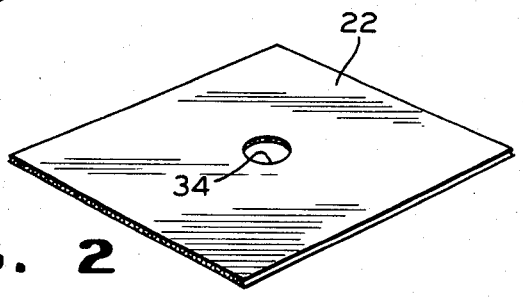
FIG. 2 is a view in perspective of a corrugated board blank formed by a rotary cutting die of FIG. 1.

Referring to the drawings, and particularly to FIG. 1, rotary cutting die equipment is indicated at 10 and includes an upper die cylinder or roll 12 and a lower backup cylinder or roll 14. A yieldable layer 16 of polyurethane plastic or other suitable material is located around the backup cylinder 14. The cylinders are rotatably mounted in a frame or stand 18 and are rotated in the direction of the arrows by suitable means (not shown). Corrugated board or similar sheet material is fed between the cylinders 12 and 14 where it is engaged by a rotary cutting die 20 and is shaped into a blank 22 (FIG. 2) from which cartons or other products can be formed. The cutting die 20 is fastened to the cylinders by any suitable means, such as fasteners 24.

In making a cutting die 20, a die plate 26 of appropriate size and thickness is used. This plate usually is made of high quality, five-eighths or one-half inch plywood formed in an arcuate shape with a radius equal to the radius of the cylinder 12. The shape of the blank 22 is then laid out on the die plate 26 and slots are formed in the die plate at appropriate positions to receive cutting rules 28 which, in this instance, form the peripheral shape of the blank 22. A hole 20 is also made in the die plate 26 to receive a hole punch 32 in accordance with the invention, which forms a hole or aperture 34 in the blank 22.

Figure 3:
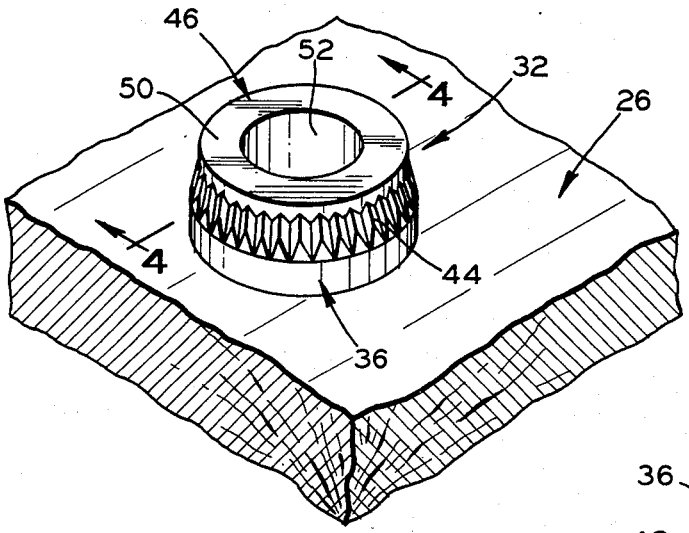
FIG. 3 is a fragmentary view in perspective of a cutting die plate and a hole punch in accordance with the invention.
Figure 4:
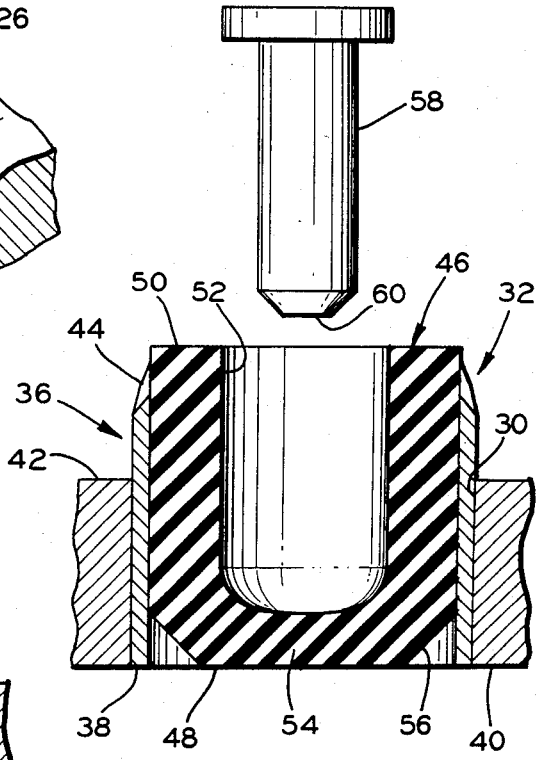
FIG. 4 is an enlarged view in cross section taken along the line 4—4 of FIG. 3 with an insertion member added.

The hole punch 32 is usually affixed in the die plate 26 and specifically in the hole 30 by a friction fit. The punch 32 includes a tubular metal member 36 of circular transverse cross section. A back end 38 of the tubular member preferably is flush with a back surface 40 of the die plate 26 so that the punch can be backed up by the die cylinder 12 when the die plate is mounted thereon. The front end of the tubular member 36 extends beyond a front surface 42 of the die plate 26 and terminates in a circular cutting edge 44. The cutting edge 44 is preferably serrated, as shown in FIG. 3, and is spaced from the front surface of the die plate 26 by a distance exceeding the thickness of the corrugated board.

An injection body 46 of resilient material is located within the tubular member 36. The body preferably is made of polybutadiene and natural rubber, and is resilient, but incompressible. The body preferably has a hardness of 40–50 durometers on the Shore-A scale. The body 46 preferably has a back end 48 terminating near the back end 38 of the tubular member 36 and a front end 50 terminating near the plane of the cutting edge 44. The end 50 of the body can extend slightly beyond or stop slightly short of the cutting edge 44. However, particularly with smaller punches, the stripping and ejecting operation is more effective with the end 50 extending slightly beyond the cutting edge 44.

In accordance with the invention, the resilient body 46 has a central void or recess 52 in the front end portion. This recess extends from about seventy-five to about ninety percent of the length of the resilient body 46, leaving a transverse end wall 54 at the back end of the body. The diameter of the recess 52 preferably is one-fourth to three-fourths of the outer diameter of the body 46 so that the side wall has a thickness from one-eighth to three-eighths of the outer diameter of the body. The transverse wall preferably has a thickness about the same as the thickness of the annular side wall of the body. Further, the body 46 has an annular chamfer or taper 56 where the outer surface of the side wall of the body would otherwise meet the outer surface of the end wall 54. This chamfer increases the effective life of the ejection body 46, apparently because it provides an annular void or space into which a portion of the side wall of the body can extend when it is pushed inwardly during a die cutting operation.

The resilient ejection body 46 is preferably frictionally held in the tubular member 36. With a friction fit, the use of adhesives or other materials is thereby eliminated, decreasing costs from both the labor and materials standpoint. However, with hole punches heretofore known, it has been difficult to insert the ejection body with a friction fit into the tubular member. To have a proper friction fit, the resilient body must be of a diameter slightly greater than that of the tubular member 36. With the resilient and incompressible nature of the body, insertion in the tubular member has been difficult and time consuming.

With the resilient body 46 in accordance with the invention having the transverse end wall 54 at the end of the recess 52, an insertion member 58 can be inserted in the recess 52 with an end 60 of the insertion member placed in engagement with the inner surface of the end wall 54. When the insertion member 58 is then moved longitudinally into the tubular member 36, it presses on the transverse wall 54 during insertion of the body 46. This pressure on the end wall increases as drag on the outer surface of the side wall of the resilient body 46 increases. This places the body 46 in tension and decreases its effective diameter. This continues until the body contacts the die cylinder 12. The assembly operation is both simple and takes a short amount of time, which can be particularly important where a number of the hole punches are used in a particular cutting die.

Figure 5:
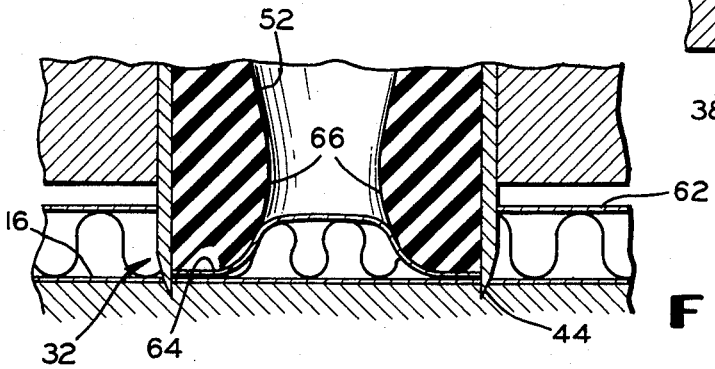
FIG. 5 is a view similar to FIG. 4 of the hole punch forming a hole in corrugated board.

In the operation of the hole punch 32, as the cylinder 12 rotates with corrugated board 62 fed therebetween, the cutting edge 44 penetrates the entire thickness of the corrugated board and preferably projects slightly into the yieldable layer 16 on the backup cylinder 14, as shown in FIG. 5. As the tubular member 36 cuts through the corrugated board 62, the front end 50 of the resilient body 46 engages the surface of the corrugated board and compresses it in an annular area 64. At this time, the resilient body 46 is pushed inwardly and the displaced material moves inwardly to form an annular bulge 66 extending into the recess 52. Without the recess 52 and the chamfer 56, the material of the resilient body 46 would have no space to be displaced and the life of the body would be considerably shortened, the life of the resilient body 46 being at least several times that of a solid resilient body.

As the punch 32 separates from the corrugated board 62, the resilient material of the body 46 resumes it original shape, causing the scrap of corrugated board to be stripped and ejected from the tubular member 36 of the punch 32. Because the material at the annular area 64 is crushed to such a thin state, substantially only the thickness of three papers, it is considerably easier to eject from the tubular member 36 than heretofore when most of the crushing took place at the center of the scrap piece.

Various modifications of the above-described embodiment of the invention will be apparent to those skilled in the art, and it is to be understood that such modifications can be made without departing from the scope of the invention, if they are within the spirit and the tenor of the accompanying claims.

We claim:

1. A cutting die forming a hole in corrugated board or the like, said cutting die including a die plate having a front surface and a back surface, an open ended tubular member held by said die plate and having one open end terminating at the back surface of said die plate, said member having another open end extending beyond the front surface of said die plate and terminating in a cutting edge, and a body of resilient material within said tubular member and having an outer diameter normally slightly exceeding the inner diameter of said tubular member, said resilient body having a central recess in one end terminating near the cutting edge of said tubular member, said resilient body having a transverse wall at said other end thereof, with the back surface of said transverse wall, the back surface of said die plate, and said one end of said tubular member being substantially in a common plane, said recess of said resilient body extending from 75 to 90 percent of the length of said body with the thickness of said transverse wall being about equal to the thickness of the side wall of said body, the outer surface of said body being cylindrical and said body having an annular chamfer, therearound where the outer cylindrical surface thereof would otherwise meet the back surface of said transverse wall.

* * * * *

UNITED STATES PATENT OFFICE

CERTIFICATE OF CORRECTION

PATENT NO. 4,522,095

DATED June 11, 1985

INVENTOR(S) Philip G. Saunders; Jack R. Simpson

It is certified that error appears in the above-identified patent and that said Letters Patent are hereby corrected as shown below:

Claim 1, line 22, after "chamfer" delete the comma (,).

Signed and Sealed this

*Third* Day of *September 1985*

[SEAL]

*Attest:*

DONALD J. QUIGG

*Attesting Officer* *Acting Commissioner of Patents and Trademarks - Designate*